US005282632A

United States Patent [19]

Allen et al.

[11] Patent Number: 5,282,632

[45] Date of Patent: Feb. 1, 1994

[54] MEMORY BLOCK GAME APPARATUS

[76] Inventors: Lillian F. Allen; Jason D. Allen, both of 3921 Pine St., Longview, Wash. 98632

[21] Appl. No.: 999,277

[22] Filed: Dec. 31, 1992

[51] Int. Cl.[5] ..... A63F 9/20

[52] U.S. Cl. ..... 273/302; 273/148 R; 273/309; 273/273

[58] Field of Search ..... 273/273, 292-309, 273/148 A, 148 R

[56] References Cited

U.S. PATENT DOCUMENTS 1,383,570 7/1921 Schnell ..... 273/148 A
3,178,185 4/1965 Ardis ..... 273/273
4,682,777 7/1987 Wood ..... 273/243
4,896,889 1/1990 Kuhn et al. ..... 273/272

*Primary Examiner*—Benjamin H. Layno
*Attorney, Agent, or Firm*—Leon Gilden

[57] ABSTRACT

An apparatus includes a plurality of sets of block members having respective pictorial and numerical designations, wherein each set includes duplicates of pictorial and numerical representations that are selected from a face-down relationship relative to one another in an effort to attempt to match such duplicates. The block members are optionally arranged for mounting within a support member to secure and position the sets for use and storage.

1 Claim, 4 Drawing Sheets

MEMORY BLOCK GAME APPARATUS

BACKGROUND OF THE INVENTION

1. Field of the Invention

The field of invention relates to game apparatus, and more particularly pertains to a new and improved memory block game apparatus wherein the same is arranged to attempt to pictorially represent matching pictorial and numerical designations relative to a plurality of sets of blocks.

2. Description of the Prior Art

Game apparatus for entertainment and amusement of individuals is indicated in U.S. Pat. Nos. 4,416,455 and 4,852,878 for the use of letters and pictorial representations in use of the game structure.

U.S. Pat. No. 4,812,123 sets forth an educational device to attempt to assist in teaching of mathematical computation and the like.

The instant invention sets forth a game apparatus wherein the same is arranged to attempt to associate like and matching pairs of respective numerical and pictorial representations and in this respect, the present invention substantially fulfills this need.

SUMMARY OF THE INVENTION

In view of the foregoing disadvantages inherent in the known types of game apparatus now present in the prior art, the present invention provides a memory block game apparatus wherein the same is arranged to include plural sets of pictorial and numerical designations for association. As such, the general purpose of the present invention, which will be described subsequently in greater detail, is to provide a new and improved memory game block apparatus which has all the advantages of the prior art game apparatus and none of the disadvantages.

To attain this, the present invention provides an apparatus including a plurality of sets of block members having respective pictorial and numerical designations, wherein each set includes duplicates of pictorial and numerical representations that are selected from a face-down relationship relative to one another in an effort to attempt to match such duplicates. The block members are optionally arranged for mounting within a support member to secure and position the sets for use and storage.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved memory block game apparatus which has all the advantages of the prior art game apparatus and none of the disadvantages.

It is another object of the present invention to provide a new and improved memory block game apparatus which may be easily and efficiently manufactured and marketed.

It is a further object of the present invention to provide a new and improved memory block game apparatus which is of a durable and reliable construction.

An even further object of the present invention is to provide a new and improved memory block game apparatus which is susceptible of a low cost of manufacture with regard to both materials and labor, and which accordingly is then susceptible of low prices of sale to the consuming public, thereby making such memory block game apparatus economically available to the buying public.

Still yet another object of the present invention is to provide a new and improved memory block game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
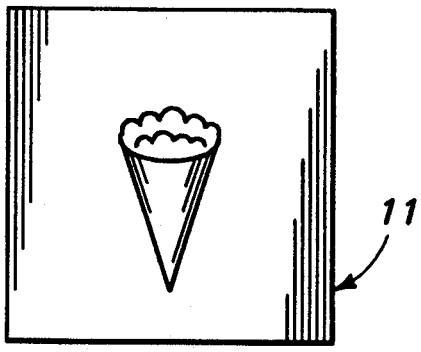
FIGS. 1, 2, 3, 4, 5, and 6 are orthographic top views of first block members.
Figure 2:
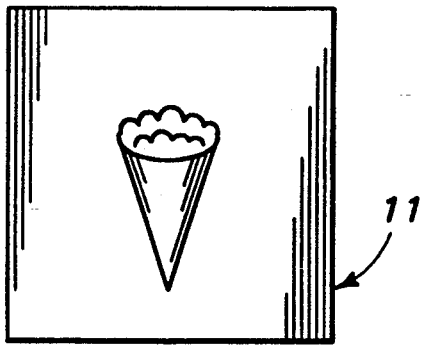
Figure 3:
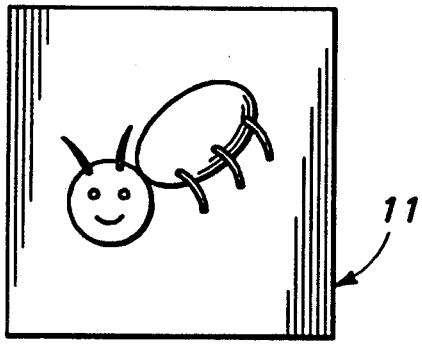
Figure 4:
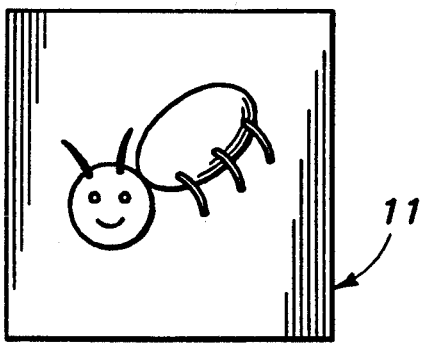
Figure 5:
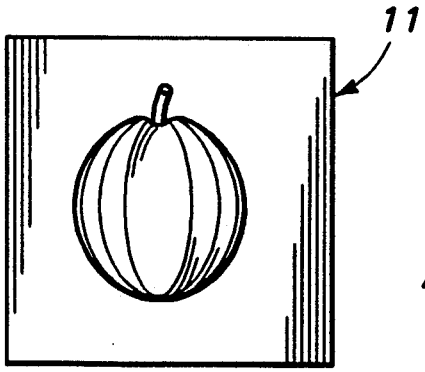
Figure 6:
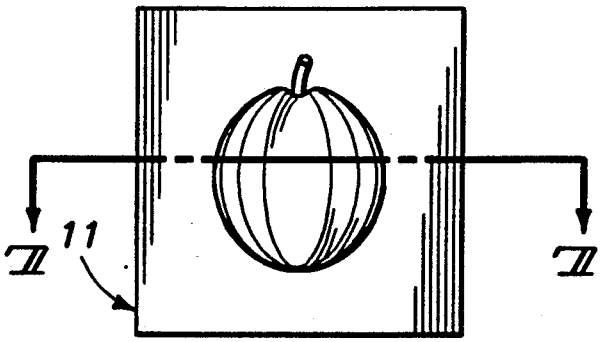
Figure 7:
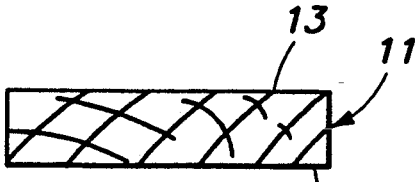
FIG. 7 is an orthographic view, taken along the lines 7—7 of FIG. 6 in the direction indicated by the arrows.
Figure 8:
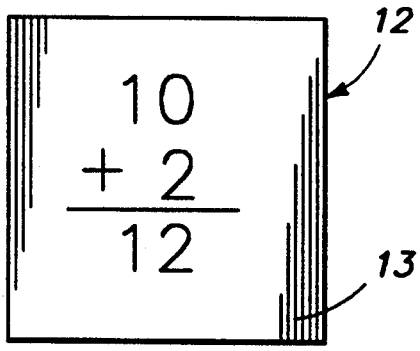
FIGS. 8, 9, 10, 11, 12, 13, 14, and 15 are pictorial representations of numerical association of second block members.
Figure 9:
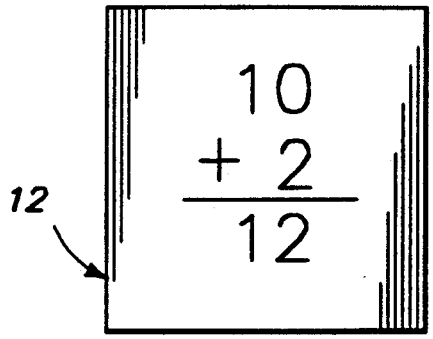
Figure 10:
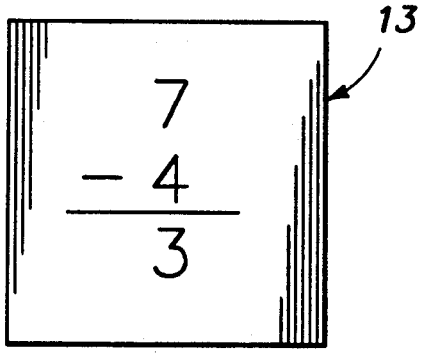
Figure 11:
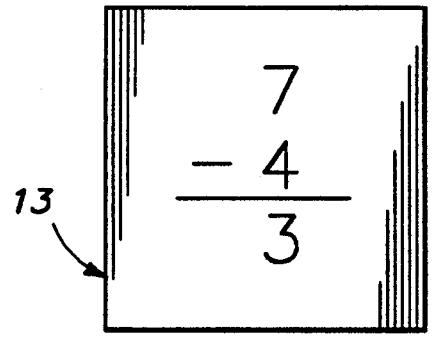
Figure 12:
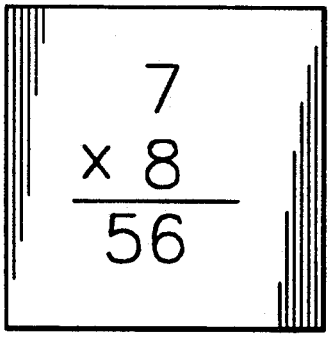
Figure 13:
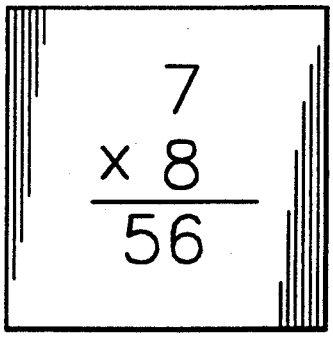
Figure 14:
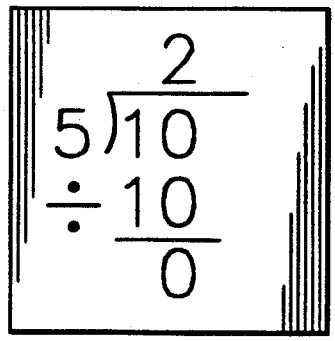
Figure 15:
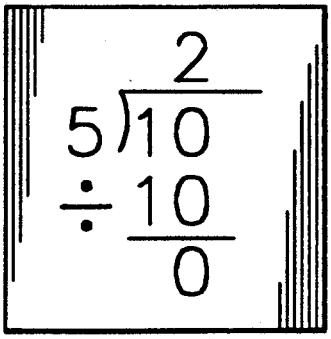

With reference now to the drawings, and in particular to FIGS. 1 to 18 thereof, a new and improved memory block game apparatus embodying the principles and concepts of the present invention and generally designated by the reference numeral 10 will be described.

More specifically, the memory block game apparatus 10 of the instant invention essentially comprises a plurality of first block members 11 having a pictorial representation, as indicated in the FIGS. 1–6, wherein a plurality of block members each include a leg representation. Similarly, second block members 12, as indicated in the FIGS. 8–15, are arranged with numerical designations, with the pictorial and numerical designations positioned upon a top wall 13 of each block member, with a bottom wall 14 of each block member blank. In this manner, the first block members 11 and second block members 12 are oriented with a respective pictorial or numerical designation face down, where individuals attempt to match by the lifting of a plurality of such block members the matching pairs of the like pictorial or numerical designations. Further, in this manner, an individual within a preselected time period to be arbitrarily decided among players, with a greatest number of such matches declared a winner.

Figure 16:
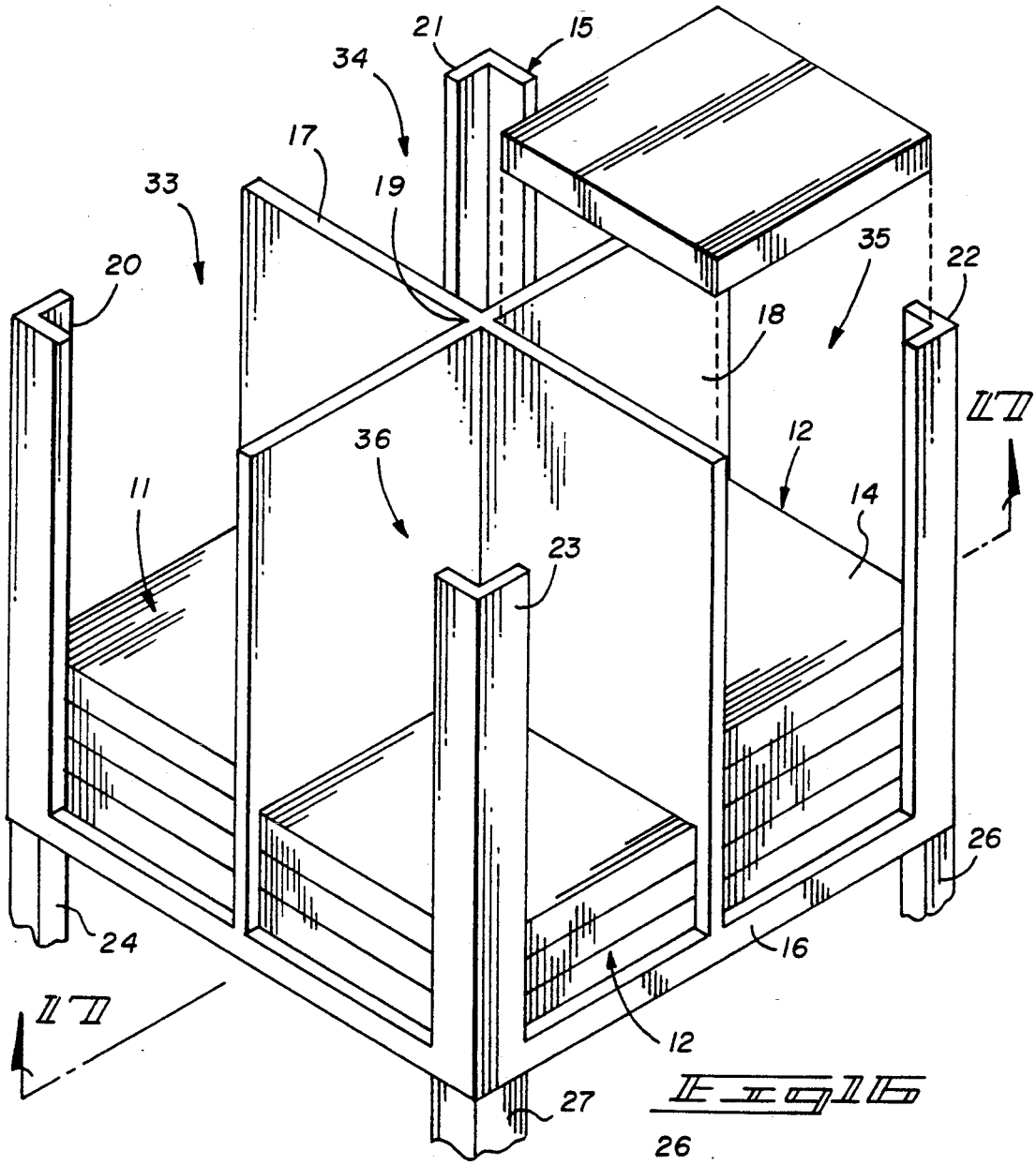
FIG. 16 is an isometric illustration of a support member.
Figure 17:
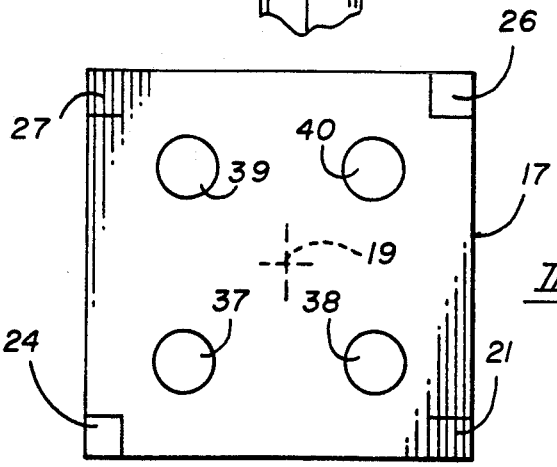
FIG. 17 is an orthographic view, taken along the lines 17—17 of FIG. 16 in the direction indicated by the arrows.

The apparatus as indicated in the FIG. 16 includes a support member 15, having a platform 16, including first and second partition walls 17 and 18 orthogonally intersecting one another and fixedly and orthogonally mounted to the support platform 16. The first and second partition walls 17 and 18 intersect one another at the intersection 19, with the platform 16 of a generally rectilinear configuration, having four corners, with a first corner including a first L-shaped leg 20 in facing relationship relative to the intersection 19, a second L-shaped leg 21 at a second corner of the platform 16, a third L-shaped leg 22 at a third corner of the platform 16, and a fourth L-shaped leg 23 at a fourth corner of the platform 16, with each of the L-shaped legs in facing relationship relative to the intersection 19 as illustrated to define respective first, second, third, and fourth columns 33, 24, 35, and 36 respectively, with a first column 33 positioned between the intersection and the first support leg 24, a second column 34 positioned between the intersection and the second support leg 25, a third column 35 oriented between the third support leg 26 and the intersection 19, and a fourth column 36 oriented between the fourth support leg 27 and the intersection 19. The first and second columns 33 and 34 support columns of first block members 11, with the third and fourth columns 35 and 36 supporting stacks of the second block members 12. The platform 16, as illustrated in FIG. 17, includes a first aperture 37 through the platform 16 for communication with the first column 33, a second aperture 38 directed through the platform 17 for communication with the second column 34, a third aperture 39 directed through the platform 16 for access to the third column 35, and a fourth aperture 40 directed through the platform 16 for access to the fourth column 36. In this manner, lifting of the blocks by means of the apertures when an individual projects an individual's finger through the aperture is available to provide for ease of lifting and access as well as manual manipulation of the blocks 11 and 12. Further, a first platform leg 24 is aligned with the first leg 20, a second platform leg 25 is aligned with the second leg 21, a third platform leg 26 is aligned with the third leg 22, and the fourth platform leg 27 is aligned with the fourth L-shaped leg 23. In this manner, the platform is arranged for a spaced relationship relative to an underlying support for ease of access to the apertures 37–40.

Figure 18B:
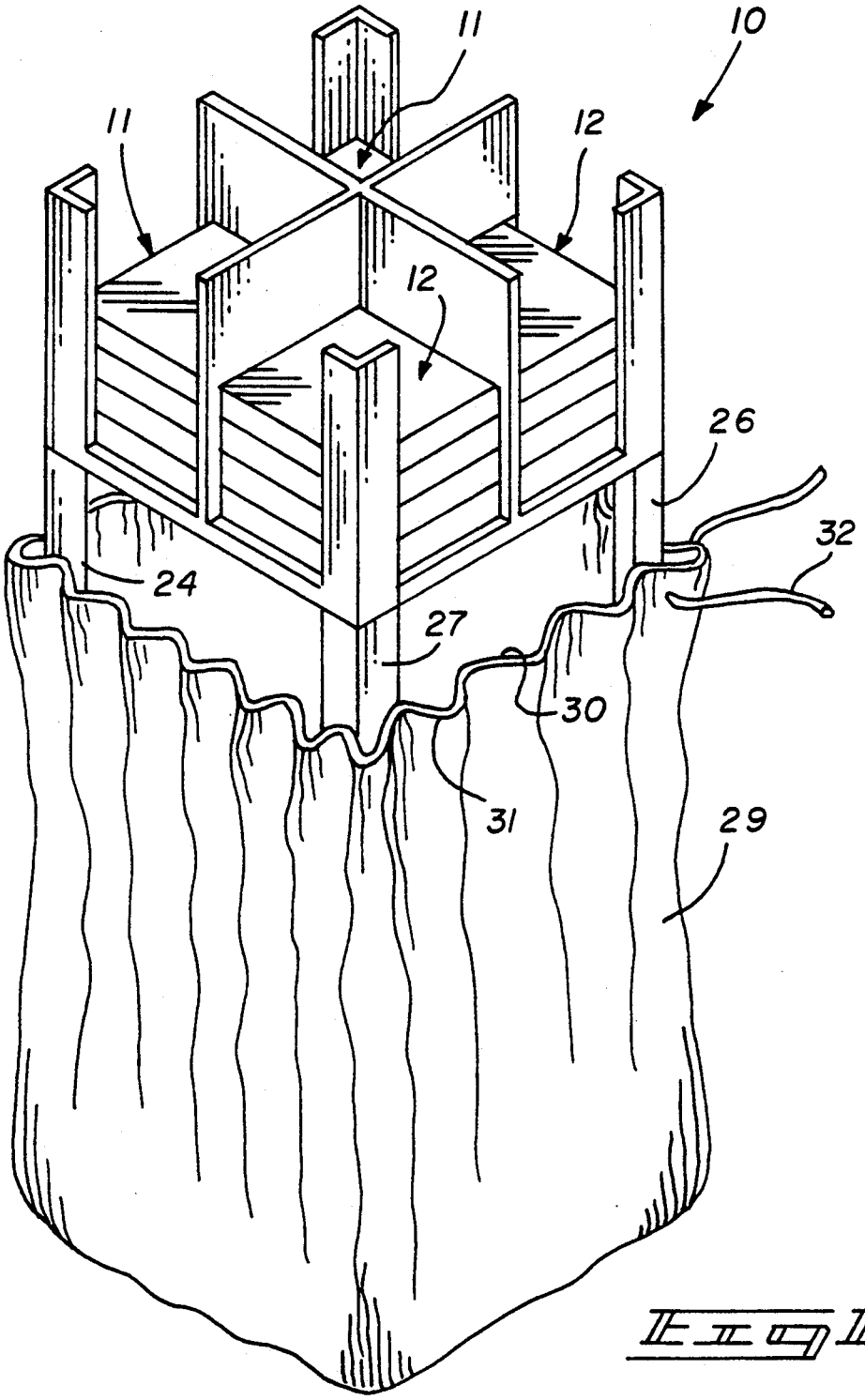
FIG. 18 is an isometric illustration of the invention employing a flexible enclosure bag.

In the apparatus as indicated in FIG. 18, the platform and associated columns of blocks are positioned within a flexible bag 29 having an entrance opening 30, with an entrance opening end 31, including a drawstring 32 to constrict opening of the entrance opening, wherein an individual positions an individual's hand therewithin and selects a plurality of blocks from the four columns in an effect to match such blocks subsequent to the blocks as selected being withdrawn from the bag. In this manner, an enhanced degree of difficulty is effected in use of the organization in an effort to obtain matching blocks. Should the blocks not match, the blocks are merely repositioned within the bag structure and optionally positioned back onto the support member 15 for access to and manipulation by the following or next sequence of players in use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and change will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A memory block game apparatus, comprising, a plurality of first block members, wherein the first block members include a first block top wall and a first block bottom wall, and a plurality of second block members, each of the second block members including a second block top wall and a second block bottom wall, wherein each first block top wall includes a pictorial representation, each second block top wall includes a numerical representation, and a plurality of first block top walls include identical pictorial representations and a plurality of second block top walls include identical numerical designations, and a support member having a support platform, the support platform including a first partition wall and a second partition wall, with the first partition wall and the second partition wall orthogonally intersecting one another medially of one another, and the first partition wall and the second partition wall are fixedly mounted to the platform in an orthogonal relationship, and the first partition wall and the second partition wall intersect at a predetermined intersection, and the support member having a rectilinear configuration, and a first corner having a first L-shaped leg in facing relationship relative to the intersection, a second L-shaped leg at a second corner of the support platform in facing relationship relative to the intersection, a third L-shaped leg fixedly mounted to the support platform in facing relationship relative to the intersection, and a fourth L-shaped leg fixedly mounted to the support platform in facing relationship relative to the intersection, wherein the first L-shaped leg, the second L-shaped leg, the third L-shaped leg, and the fourth L-shaped leg are parallel relative to one another, with a first column of first block members mounted on the support platform between the first L-shaped leg and the intersection, a second column of first block members mounted on the support platform between the second L-shaped leg and the intersection, a third column of second block members mounted on the support platform between the third L-shaped leg and the intersection, and a fourth column of second block members mounted on the support platform between the fourth L-shaped leg and the intersection, wherein each of the first, second, third, and fourth columns are arranged for manual manipulation and lifting by an individual in an effort to match a plurality of said first block members and said second block members, and the support platform includes a first platform leg aligned with the first L-shaped leg, a second platform leg aligned with the second L-shaped leg, a third platform leg aligned with the third L-shaped leg, and a fourth platform leg aligned with the fourth L-shaped leg, wherein each of the first, second, third, and fourth L-shaped legs are mounted to a top surface of the support platform, and each of the first, second, third, and fourth platform legs are mounted to a bottom surface of the support platform, with a first aperture directed through the platform below the first column, a second aperture directed through the support platform below the second column, a third aperture directed through the support platform below the third column, a fourth aperture directed through the support platform in communication with the fourth platform, wherein access to each said aperture is availed by each said platform leg spaced above a support surface by the first, second, third, and fourth platform legs, and a flexible bag having an entrance opening end, and a drawstring directed through the flexible bag adjacent the entrance opening and the support platform positioned within the flexible bag for access by an individual upon directing the drawstring in a surrounding and enclosing relationship to restrict visual access within the flexible bag during selection of a plurality of said block members.

* * * * *